United States Patent [19]

Schweizer et al.

[11] 3,950,002

[45] Apr. 13, 1976

[54] FRONT JAWS FOR SKI BINDINGS

[75] Inventors: Gottfried Schweizer; Josef Koos, both of Vienna; Thomas G. Smolka, Vienna-Mauer, all of Austria

[73] Assignee: Gertsch AG, Zug, Switzerland

[22] Filed: Mar. 28, 1975

[21] Appl. No.: 562,979

Related U.S. Application Data

[63] Continuation of Ser. No. 348,750, April 6, 1973, abandoned.

[30] Foreign Application Priority Data

Apr. 6, 1972 Austria ..... 2945/72

[52] U.S. Cl. ..... 280/11.35 T

[51] Int. Cl.[2] ..... A63C 9/08

[58] Field of Search ..... 280/11.35 T

[56] References Cited

UNITED STATES PATENTS

| | | | |
|---|---|---|---|
| 3,194,574 | 7/1965 | Beyl | 280/11.35 T |
| 3,584,891 | 6/1971 | Khazzam | 280/11.35 T |
| 3,603,607 | 9/1971 | Marker | 280/11.35 T |
| 3,638,959 | 2/1972 | Reuge | 280/11.35 T |
| 3,743,308 | 7/1973 | Allsop | 280/11.35 T |

*Primary Examiner*—Robert R. Song

*Attorney, Agent, or Firm*—Woodhams, Blanchard and Flynn

[57] ABSTRACT

A front jaw for ski bindings having two pivotal levers engageable with the toe of a ski boot adjacent opposite sides thereof. The levers are pivotal at a point intermediate the ends thereof so that the levers each have a long arm portion which is engageable with the toe of the ski boot and a short arm portion which engages a spring control mechanism for regulating the pressure which is required in order to release the ski boot from the ski binding. The shorter arms are, more particularly, engaged with a longitudinally movable spring rod which is movable longitudinally of the ski depending upon the lateral force applied to the ends of the longer arm portion of the pivotal levers.

17 Claims, 8 Drawing Figures

FRONT JAWS FOR SKI BINDINGS

This is a continuation of application Ser. No. 348,750, filed Apr. 6, 1973, now abandoned.

FIELD OF THE INVENTION

The invention relates to front jaws for ski bindings with two rocking levers which are rotatably supported on a base plate which is fixedly connected to the ski, which rocking levers can be swung outwardly against the effect of a common spring, and stops to receive the forces which act toward the ski tip.

BACKGROUND OF THE INVENTION

Known devices of this kind are rather expensive and complicated in structure. The rocking levers are connected through hinge arms which in turn have rollers thereon and on which the toe of the ski boot is supported or rolls along laterally during a swinging-out or release movement, while the rollers themselves are pulled to the side by the hinge arms and the rocking levers. Since the hinge levers themselves are hinged to a common spring through an intermediate member, the spring unit must be supported swingably. Through this the here described known device requires much space and a relatively wide cover housing.

The purpose of the invention is to produce front jaws for ski bindings which are characterized by a simple construction and space-saving design.

This is achieved by constructing the rotatably supported rocking levers with two arms, whereby the longer portion of the lever arms abut the ski boot, while the ends of the shorter portion of the lever arms are hinged to an intermediate member — for example a spring rod, which intermediate member is connected to the spring, and by securing the spring against a lateral swing.

The requirement exists for safety bindings that the ski boot, after exceeding a certain angle of twist, can swing free from the binding. For this, it is actually sufficient if the ends of the rocking levers, which ends abut the ski boot, carry rollers. If the rollers are at the same level as the stops which absorb the forces which act toward the ski tip, the boot can be turned from the binding without lateral resistance.

In a preferred embodiment, it is provided that the rocking levers can, by exceeding a certain angle of rotation, be disengaged from the hinged connection with the intermediate member.

This is achieved, for example, by constructing the rocking levers of two pieces, whereby the two parts are connected rotatably by means of a pivot pin or the like so that a rotation of the two parts relatively to one another is limited by a stop.

In order to make the return of the rocking levers easier, it is furthermore suggested to hold the two parts of each rocking lever against the stop by a tension spring, whereby the ends of the spring are each secured to one part of the lever. Rocking levers having this type of construction can also be equipped with rollers which abut the boot laterally and make the swinging-out movement thereof easier.

If the frictional resistance during the swinging-out movement of the ski boot are supposed to be reduced to a minimum, the stops which absorb the forces which act toward the ski tip, and which stops are actually rigidly connected to the base plate, can be provided with hinged rollers or gliding sleeves.

Finally, it is possible to adjust the initial stress of the spring by means of an adjusting mechanism in order to individually determine the force which is required for pressing out the boot.

Three exemplary embodiments of the invention are illustrated in connection with the drawings, in which:

FIG. 1 is a top view of the inventive front jaw in its normal position,

FIG. 2 is a cross-sectional side view along the plane of symmetry of FIG. 1, FIG. 3 is a top view and a partial cross-sectional view of the same exemplary embodiment with opened pivotal or rocking levers, FIG. 4 is a top view of a further exemplary embodiment, FIG. 5 is the cross-sectional side view along the plane of symmetry in FIG. 4, FIG. 6 is a top view or a horizontal partial cross-sectional view of a third exemplary embodiment in a normal ski boot engaging position, whereby the spring element is only partially illustrated, FIG. 7 is a top view of the same jaw as in FIG. 6, whereby the left lever is swung out, and FIG. 8 is a horizontal cross-sectional view of the left pivotal or rocking lever during the return process.

DETAILED DESCRIPTION

Figure 2:
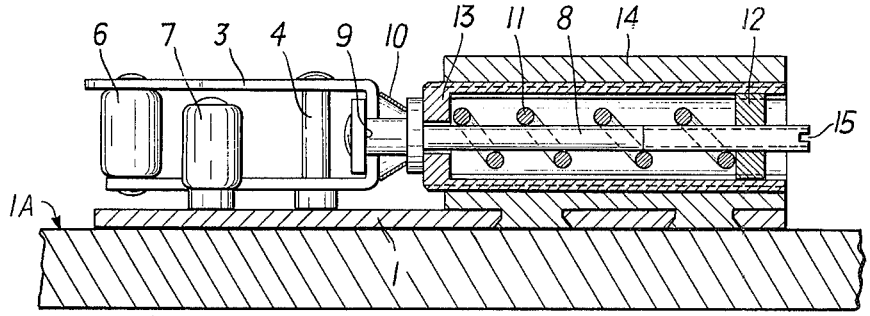
Figure 1:
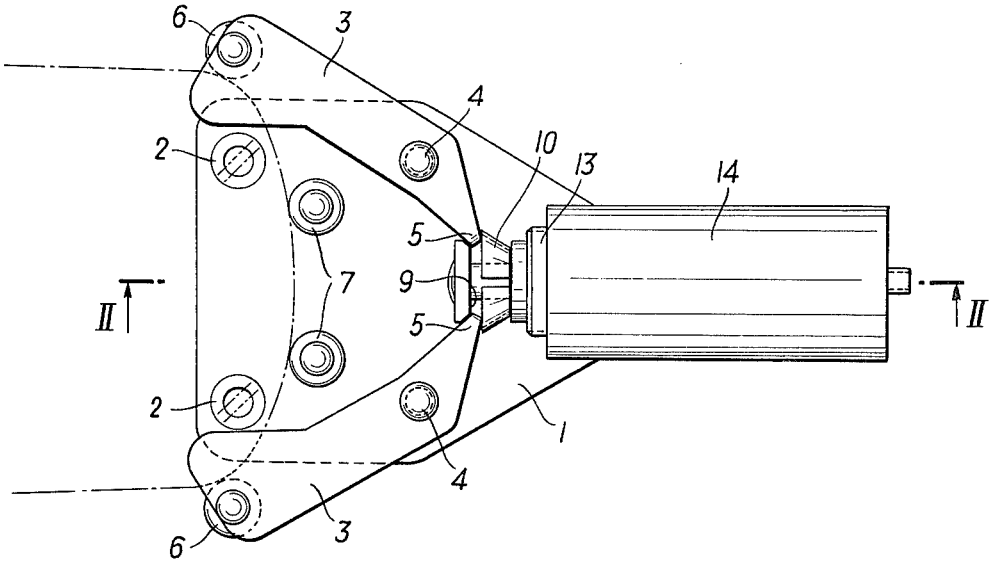
Figure 3:
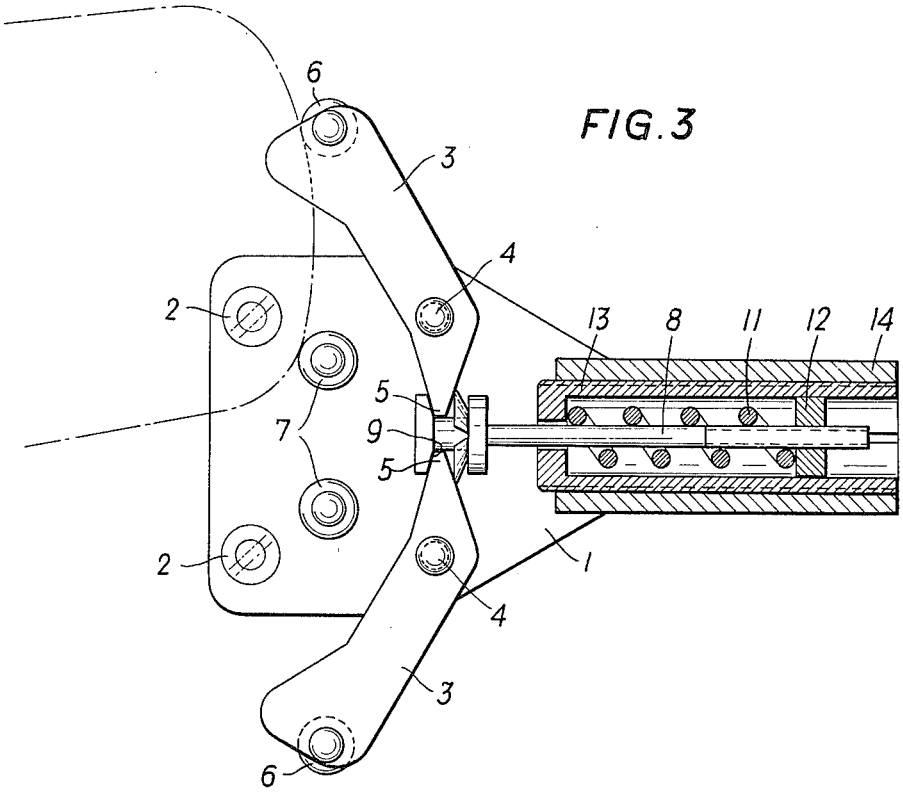

The base plate 1 of the front jaw is secured by means of screws 2 on a ski 1A. In the normal position of the front jaw, the toe of the ski boot, the contour of which is illustrated by dash-dotted lines, abuts the abutments or support rollers 7 (FIG. 1). The two-arm pivotal rocking levers 3 of the jaw are rotatably supported on pivot pins 4 located intermediate the ends thereof and have, at the ends of the longer ones of their lever arms, rollers 6 which laterally abut the ski boot. The ends 5 of the shorter ones of their lever arms are pressed against an end stop 9 on the end of a spring rod 8 which extends through the center of a spring 11, here a compression spring, and an elastic sleeve 10 and are thus effectively hingedly connected to the end of the spring rod 8. The frontmost end of the spring rod 8 has a thread onto which a nut 12 is screwed and is fixedly guided for longitudinal movement in a sleeve 13; the spring rod 8 can be rotated for the purpose of adjusting the initial stress of the spring 11 and has a slot 15 in the end thereof for receiving a screw driver. The sleeve 13 itself is threadedly connected into a housing 14 which in turn is rigidly connected to the ski.

Figure 5:
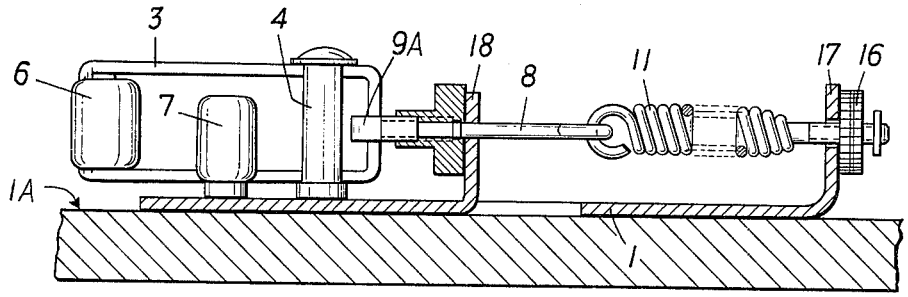
Figure 4:
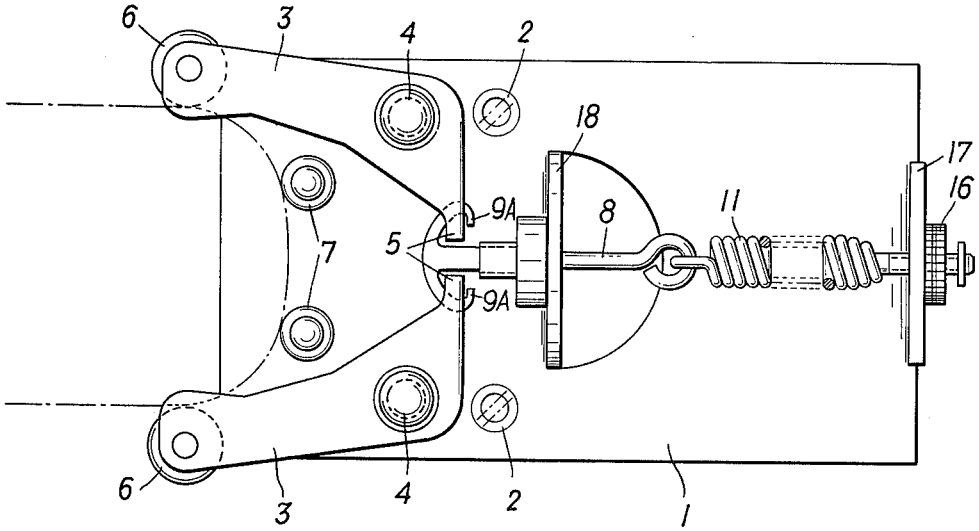

In the case of the spring element of the exemplary embodiment illustrated in FIGS. 4 and 5, the spring 11, which is constructed as an extension spring, is hinged at its rear end to the spring rod 8; its frontmost end is guided through a portion 17 of the base plate 1, which portion is bent up at 90°, and has a thread thereon onto which a hand-operated nut 16 is screwed and urged by the spring 11 against the guide portion 17.

The spring rod 8 is placed through a second guide member 18 and has a bifurcated hook 9A which grips behind the ends 5 of the shorter ones of the arms of the rocking levers 3.

Figure 8:
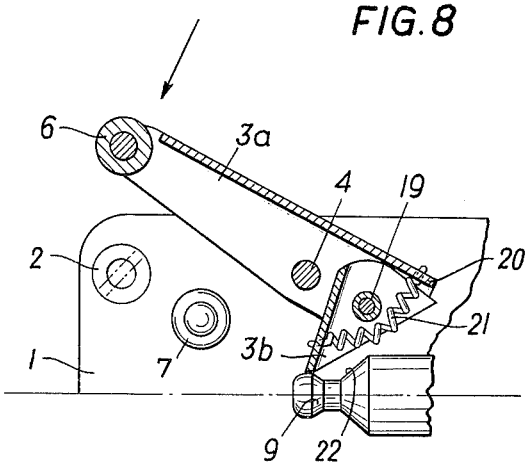
Figure 6:
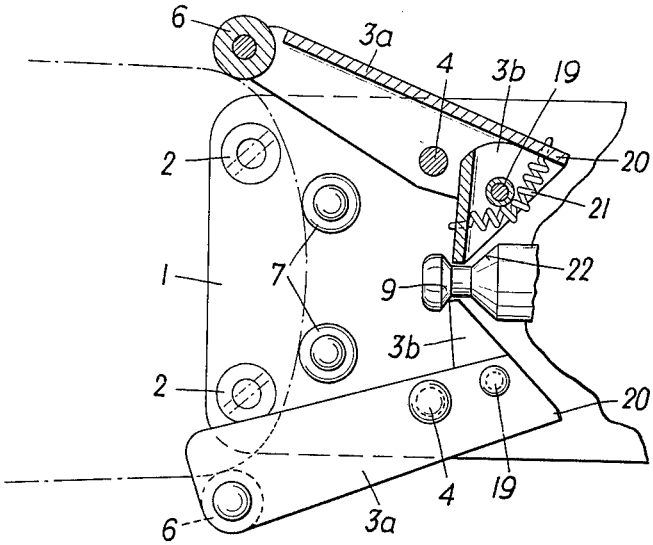
Figure 7:
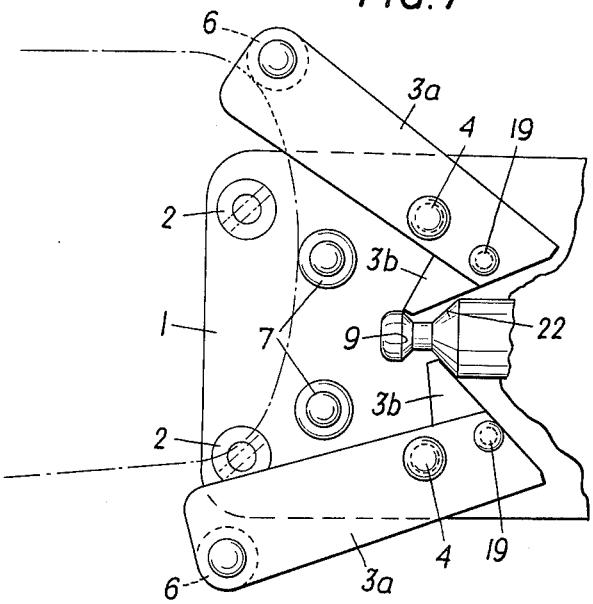

Finally, the exemplary embodiment which is illustrated in FIGS. 6 to 8 is discussed. Here, each pivotal or rocking lever is constructed in two pieces and consists of a longer part **3*a* and a shorter part 3*b*. Both parts are rotatably connected by means of a pivot pin 19. A movement of the longer part 3*a* of the rocking lever will effect a movement of the smaller part 3*b* and the spring element 21 during its turning-out movement to a stop 20 (FIGS. 6 and 7) and at least until the part 3***b* becomes disengaged from the end stop surface 9 (FIG. 7). The ski boot (llustrated in dash-dotted lines) can now, without any further resistance, be rotated completely from the binding. During the return movement, the direction of which is indicated by an arrow in FIG. 8, the spring 21 pulls the smaller part 3b of the rocking lever into its initial position so that it again is engaged between the stop surfaces 9 and 22 which are conically constructed.

Since in all exemplary embodiments the spring element can be moved only in the axial direction, the housing must only cover the spring, for which reason it may be made very small.

The embodiments of the invention for which an exclusive property or privilege is claimed are defined as follows:

1. A front jaw for ski bindings, comprising:

a base plate fixedly secured to a ski;

a pair of horizontally spaced rocking levers each having a long arm and a short arm, each of said long arms being adapted to engage the toe of a ski boot;

a pair of horizontally spaced support means mounted on said base plate and extending perpendicularly upwardly from said base plate for rotatably supporting each of said rocking levers on said base plate; and resilient means mounted on said base plate, said resilient means including a spring and means defining an elongated rod mounted for reciprocal movement parallel to the longitudinal axis of said ski, said rod extending away from said toe of said ski boot toward the tip of said ski and having a body portion and first coupling means comprising one of means defining an annular groove and means defining a pair of hooks on an end of said body portion adjacent said toe of said ski boot, second coupling means on each of said shorter arms of said rocking levers adapted to be coupled to said first coupling means while remaining spaced from said body portion while said rocking levers pivot through a majority of their limits of movement whereby a rotatable movement of at least one of said rocking levers will effect a longitudinal shifting of said rod against the return force of said spring and without said second coupling means impeding said longitudinal shifting of said rod.

2. The front jaw according to claim 1, wherein said first coupling means is said pair of hooks and said second coupling means on each short arm is adapted to engage one of said hooks.

3. The front jaw according to claim 2, wherein said spring is an extension spring and a longitudinal movement of said rod effects a stretching of said spring.

4. A front jaw for ski bindings, comprising:

a base plate fixedly secured to a ski;

a pair of horizontally spaced rocking levers each having a long arm and a short arm, each of said long arms being adapted to engage the toe portion of a ski boot, said long arms and said short arm of each rocking lever being pivotally connected together about a pivot axis and movable relative to each other about said pivot axis, a first spring connected to and extending between said long arm and said short arm to bias said short arm into engagement with a stop on said long arm to thereby limit the relative movement between said long arm and said short arm in at least one direction of movement about said pivot axis;

a pair of horizontally spaced support means mounted on said base plate and extending perpendicularly upwardly from said base plate for rotatably supporting each of said rocking levers on said base plate; and resilient means mounted on said base plate, said resilient means including a second spring and means defining an elongated rod mounted for reciprocal movement parallel to the longitudinal axis of said ski, said rod extending away from said toe portion of said ski boot toward the tip of said ski and having first coupling means comprising an annular groove on an end thereof adjacent said toe of said ski boot, second coupling means comprising a part on each of said shorter arms of said rocking levers adapted to be received in said annular groove whereby a rotatable movement of at least one of said rocking levers will effect a longitudinal shifting of said rod against the return force of said second spring.

5. The front jaw according to claim 4, wherein the sidewall surfaces of said annular groove both have a conical characteristic whereby a rotational movement of at least one of said long arms away from said longitudinal axis of said ski will effect a movement of said second coupling means along one of said conical surfaces of said annular groove, said short arm being in engagement with said stop during the aforesaid movement of said long arm, said second spring resiliently pulling said short arm along therewith when said long arm is moved toward said longitudinal axis of said ski in the other direction of movement about said pivot axis.

6. The front jaw according to claim 4, including means defining rollers at the free ends of each of said long arms.

7. The front jaw according to claim 4, including abutment means mounted on said base plate between said pair of long arms on said pair of rocking levers to prevent movement of said ski boot longitudinally of said ski toward the tip thereof.

8. The front jaw according to claim 7, wherein said abutment means are conventional rollers.

9. The front jaw according to claim 4, including means for facilitating an adjustment of the initial tension of said spring.

10. The front jaw according to claim 4, wherein said spring is a compression spring and a longitudinal movement of said rod effects a compression of said spring.

11. A front jaw for ski bindings, comprising:

a base plate fixedly secured to a ski;

housing means mounted on said base plate and rigidly connected thereto, said housing means being incapable of moving relative to said ski;

a pair of horizontally spaced rocking levers each having a long arm and a short arm rigidly connected together, each of said long arms being adapted to engage the toe of a ski boot;

a pair of horizontally spaced support means mounted on said base plate and extending perpendicularly upwardly from said base plate or rotatably supporting each of said rocking levers on said base plate; and resilient means mounted on said housing means, said resilient means including a spring and means defining an elongated rod mounted for reciprocal movement parallel to the longitudinal axis of said ski, said rod extending away from said toe of said ski boot toward the tip of said ski and having first coupling means comprising an annular groove on an end thereof adjacent said toe of said ski boot, second coupling means comprising a part on each of said shorter arms of said rocking levers adapted to be received in said annular groove whereby a rotatable movement of at least one of said rocking levers will effect a longitudinal shifting of said rod against the return force of said spring, said first coupling means including means defining an elastic sleeve, one side of said part on said short arm engaging one wall of said annular groove, the other side thereof engaging said elastic sleeve means which urges said one side into engagement with said one wall of said annular groove.

12. The front jaw according to claim 11, wherein said long arm and said short arm of each rocking lever is pivotally connected together about a pivot axis and movable relative to each other about said pivot axis, a second spring connected to and extending between said long arm and said short arm to bias said short arm into engagement with a stop on said long arm to thereby limit the relative movement between said long arm and said short arm in at least one direction of movement about said pivot axis.

13. The front jaw according to claim 11, including means defining rollers at the free ends of each of said long arms.

14. The front jaw according to claim 11, including abutment means mounted on said base plate between said pair of long arms on said pair of rocking levers to prevent movement of said ski boot longitudinally of said ski toward the tip thereof.

15. The front jaw according to claim 14, wherein said abutment means are conventional rollers.

16. The front jaw according to claim 11, including means for facilitating an adjustment of the initial tension of said spring.

17. The front jaw according to claim 11, wherein said spring is a compression spring and a longitudinal movement of said rod effects a compression of said spring.

* * * * *